US005125345A

United States Patent [19]

Theurer et al.

[11] Patent Number: 5,125,345

[45] Date of Patent: Jun. 30, 1992

[54] TIE EXCHANGE MACHINE

[75] Inventors: Josef Theurer, Vienna; Herbert Wörgötter, Linz, both of Austria

[73] Assignee: Franz Plasser Bahnbaumaschinen-Industriegesellschaft m.b.H., Vienna, Austria

[21] Appl. No.: 719,765

[22] Filed: Jun. 24, 1991

[30] Foreign Application Priority Data

Aug. 24, 1990 [AT] Austria ..... 1744/90

[51] Int. Cl.[5] ..... E01B 27/11

[52] U.S. Cl. ..... 104/9; 37/104

[58] Field of Search ..... 104/9, 2, 6, 7.1, 7.2, 104/7.3, 12; 37/104

[56] References Cited

U.S. PATENT DOCUMENTS 4,862,806 9/1989 Theurer et al. ..... 104/9
4,878,435 11/1989 Theurer ..... 104/9
4,955,301 9/1990 Theurer et al. ..... 104/9
5,046,270 9/1991 Theurer et al. ..... 37/104

FOREIGN PATENT DOCUMENTS 0057128 5/1984 European Pat. Off. .

*Primary Examiner*—Robert J. Oberleitner
*Assistant Examiner*—Mark T. Le
*Attorney, Agent, or Firm*—Collard & Roe

[57] ABSTRACT

A machine for exchanging old ties of a railroad track for new ties comprises a machine frame supported by undercarriages for mobility along the track, a longitudinally, vertically and transversely displaceable tie exchange device connected to the machine frame for laterally pulling the old ties out of the track and laterally inserting the new ties in the track at a tie exchange position, and a ballast scarifying device for clearing ballast at the tie exchange position. According to the invention, the machine has a carrier frame for the ballast scarifying device, the carrier frame having opposite ends longitudinally spaced from each other, an undercarriage supports one of the carrier frame ends on the track adjacent the ballast scarifying device, and a pivot links the opposite carrier frame end to the machine frame.

10 Claims, 1 Drawing Sheet

TIE EXCHANGE MACHINE

BACKGROUND OF THE INVENTION

1. Field of the Invention

The present invention relates to a machine for exchanging old ties of a railroad track for new ties, the track being comprised of two rails fastened to the ties defining cribs therebetween and the rail having gage and field sides, which comprises a machine frame supported by undercarriages for mobility along the track, a longitudinally, vertically and transversely displaceable tie exchange device connected to the machine frame for laterally pulling the old ties out of the track and laterally inserting the new ties in the track at a tie exchange position, and a ballast scarifying device for clearing ballast at the tie exchange position.

Throughout the specification and claims, the directional terms "transversely" and "longitudinally" refer to the direction with respect to the longitudinal extension of the track.

2. Description of the Prior Art

European patent No. 0 057 128, published Aug. 4, 1982, discloses a tie exchanging machine of this general type, which comprises a tie exchange device for pulling the old ties and inserting the new ties, and a ballast scarifying device equipped with a ballast excavator for clearing the ballast at the tie exchange site, which is suspended on the machine frame by a parallelogram guide for longitudinally displacing the ballast scarifying device. The lower end of this complex mechanism is supported on the track by small retractible wheels. With this ballast scarifying device, the ballast is skimmed and temporarily stored in the excavator after the old tie has been pulled out and before the new tie is inserted at the tie exchange site. While the new tie is inserted, the ballast scarifying device is longitudinally displaced from the tie exchange site and, after the new tie has been inserted, the stored ballast is emptied thereover from the excavator. The longitudinally displaceable ballast scarifying device is relatively complicated because it requires not only power-actuated drives for the operating displacement of the excavator but additional power-actuated drives for the displacement of the lower portion of the device supported by the wheels on the track relative to the upper portion suspended from the machine frame.

U.S. Pat. No. 4,955,301, dated Sep. 11, 1990, discloses a tie exchange train comprising a series of bridge-like machine frames coupled to each other and carrying different tie exchange devices longitudinally displaceably mounted on the machine frames. The old ties are removed by a tie exchange device mounted on a bridge-like machine frame at the front of the train and the new ties are inserted by a tie exchange device mounted on a bridge-like machine frame at the rear of the train. The tie exchange devices are arranged on a longitudinally extending auxiliary carrier which is longitudinally displaceable and has one end supported on the railroad track by an undercarriage while an opposite auxiliary carrier end is pivotally supported on the machine frame. The old ties are deposited from the tie exchange device withdrawing the old ties from the track on a conveyor band extending below the auxiliary frame. The conveyor band conveys the old ties from an end of the conveyor band adjacent the tie exchange device to an opposite conveyor band end where they are transferred to an ascending conveyor. The old ties collected on the ascending conveyor are conveyed to a storage area on top of the machine frame where the old ties are stacked. The stack of old ties is then removed by means of a mobile crane which is mounted on, and runs along, the train. The new ties are similarly, and in reverse order, conveyed to the tie exchange device which inserts the new ties in the track. This machine includes a further bridge-like machine frame under which a ballast scarifying device is mounted on an independently movable carriage whose ends are supported by undercarriages on the track. The ballast scarifying device has vertically and transversely adjustable ballast clearing and planing elements. Such a tie exchange train works very efficiently for exchanging ties, particularly in groups of three or four adjacent ties, in an assembly line fashion as the train advances continuously along the track.

SUMMARY OF THE INVENTION

It is the primary object of this invention to provide a tie exchange machine of the first-described type with a structurally simplified mounting for the ballast scarifying device, which also assures centering of the device with respect to the track.

In a machine for exchanging old ties of a railroad track for new ties and which comprises a machine frame supported by undercarriages for mobility along the track, a longitudinally, vertically and transversely displaceable tie exchange device connected to the machine frame for laterally pulling the old ties out of the track and laterally inserting the new ties in the track at a tie exchange position, and a ballast scarifying device having ballast clearing elements for clearing the ballast in the crib at the tie exchange position, the above and other objects are accomplished according to the invention with a carrier frame for the ballast scarifying device, the carrier frame having opposite ends longitudinally spaced from each other, an undercarriage supporting one of the carrier frame ends on the track adjacent the ballast scarifying device, and a pivot linking the opposite carrier frame end to the machine frame.

Such a carrier frame mounting the ballast scarifying device on the machine frame has the great advantage that the ballast clearing elements need not be linked to the machine frame by complex mechanisms prone to misfunctioning but may be rigidly affixed to the carrier frame by means of vertical and transverse guides. Yet, the pivoting of one end of the carrier frame to the machine frame and the support of a longitudinally spaced, opposite end of the carrier frame on the track assures an automatic centering of the carrier frame and the ballast clearing elements over the track. In this respect, the structure of this invention has the additional advantage that an erroneous level of the track and a resultant change in the vertical distance between the machine frame and the undercarriage supporting the carrier frame has no unfavorable influence on the operation of the ballast scarifying device and, therefore, may be ignored in the structure of the mounting of the ballast clearing elements.

If the carrier frame supporting undercarriage and the adjacent ballast scarifying device are arranged between the tie exchange device and the pivot, the carrier frame will not interfere with the operation of the tie exchange device and, at the same time, the tie exchange and ballast scarifying devices may be longitudinally spaced close to each other so that the longitudinal displacement paths thereof may be held to a minimum during a tie exchange operation.

According to a preferred embodiment, the machine further comprises longitudinal guide means on the machine frame for longitudinally displaceably supporting and guiding the pivot, and a drive connected to the pivot for longitudinally displacing pivot and the carrier frame along a longitudinal displacement path corresponding at least to a minimum distance between the ballast clearing elements and the tie exchange device. This enables a ballast clearing operation to be effected immediately after an old tie has been pulled out of the track at the tie exchange site by longitudinally displacing the carrier frame with the ballast scarifying device until the ballast clearing elements are centered over the site. This has the advantage that only a minor portion of the entire machine weight requiring a correspondingly small amount of energy has to be rapidly displaced.

According to another preferred embodiment, the machine further comprises a track lifting device mounted on the carrier frame adjacent the ballast clearing elements, the track lifting device comprising means for laterally engaging a respective one of the track rails and a lifting drive having an upper end, a longitudinal guide track on the machine frame, and a carriage supported and guided on the guide track for longitudinal displacement, the upper end of the lifting drive being connected to the carriage. This arrangement not only enables the track to be slightly raised to facilitate the tie exchange but also connects the carrier frame with the track. This interconnection dependably prevents the undercarriage supporting the one carrier frame end from being lifted off the track by strong forces due to heavily encrusted ballast, which counteract the immersion of the ballast clearing elements in the ballast. At the same time, the track lifting will also cause the ballast clearing elements to be raised for centering them with respect to the track.

Preferably, the machine further comprises a guide rod linking the carriage to the carrier frame, the guide rod extending at an angle to the longitudinal extension of the machine frame. In this way, the point at which the lifting drive is linked to the carriage will always be above the track lifting device, regardless of the position of the carrier frame relative to the machine frame.

If the tie exchanging machine further comprises a vertically adjustable tamping head mounted between the pivot and the ballast clearing elements, the tamping head comprising vibratory and longitudinally reciprocable tamping tools, the newly inserted tie may be immediately tamped. The tamping head is preferably connected to the carrier frame so that the ballast scarifying as well as the tamping operation may be effected merely by longitudinally displacing the carrier frame.

Preferably, the machine further comprises a tie depositing device arranged to receive old ties pulled out of the track, and new ties to be inserted in the track, by the tie exchange device. The tie exchange device includes tie clamps adjustable to engage and release a respective one of the ties to be exchanged. The ballast clearing elements of the ballast scarifying device and the tie clamps of the tie exchange device define therebetween a longitudinal distance which corresponds to a maximum distance between the tie clamps and the tie depositing device upon longitudinal displacement of the carrier frame. In this way, the tie exchange operation may also be effected by the longitudinal displacement of the carrier frame, the special spacing between the ballast scarifying, tie exchange and tie depositing devices assuring an automatic centering of the ballast clearing elements at the tie exchange site.

In accordance with another preferred embodiment, the ballast scarifying device has four ballast clearing elements, the ballast clearing elements being transversely spaced from each other and being transversely and vertically displaceably connected to the carrier frame, two of the ballast clearing elements being arranged adjacent the field sides of the rails and being pivotal about longitudinally extending axes on the carrier frame, and further comprising pivoting drives connecting the two ballast clearing elements to the carrier frame, the pivoting range of the two ballast clearing elements being increased if the pivoting axes and the lower ends of the pivotal ballast clearing elements define a distance corresponding at least to a distance between two adjacent ones of the transversely spaced ballast clearing elements. In this way, the two field side ballast clearing elements will be able rapidly and fully to clear the ballast in the direction of the track shoulders. The field side ballast clearing elements may be pivoted so that their operating width during the transverse displacement is increased, which is helpful in avoiding accumulation of ballast near the track shoulder, such ballast accumulation hindering the insertion of the new ties.

BRIEF DESCRIPTION OF THE DRAWING

The above and other objects, advantages and features of this invention will become more apparent from the following description of certain now preferred embodiments thereof, taken in conjunction with the accompanying, somewhat schematic drawing wherein.

DETAILED DESCRIPTION OF PREFERRED EMBODIMENT

Figure 1:
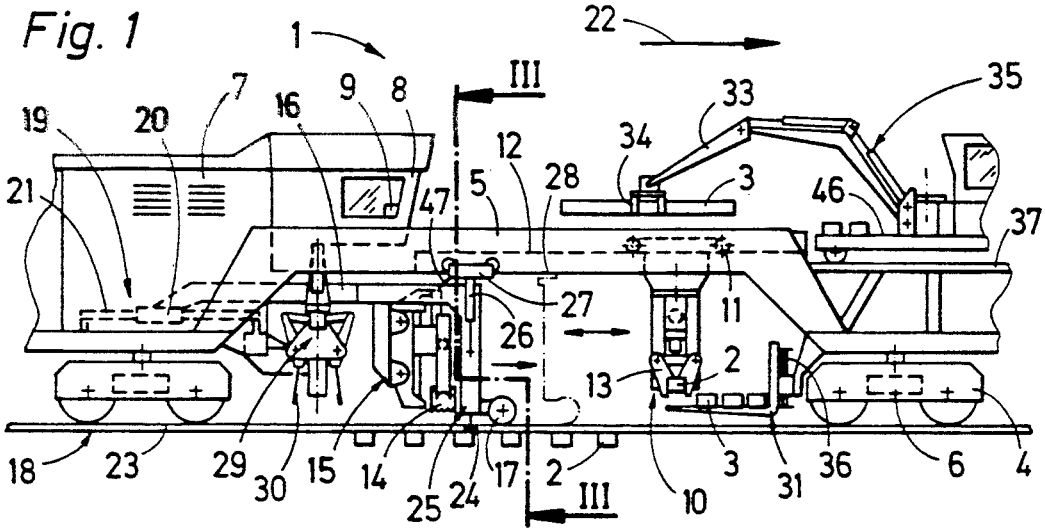
FIG. 1 is a fragmentary side elevational view of a tie exchange machine according to the invention.
Figure 2:
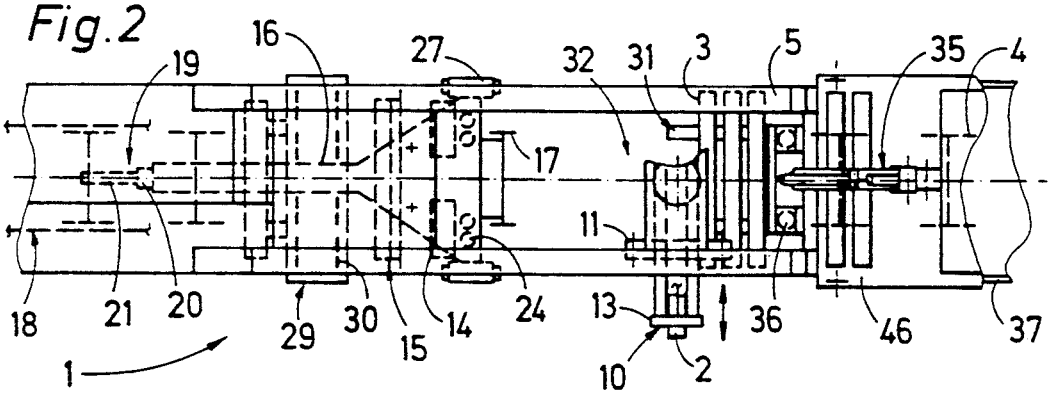
FIG. 2 is a simplified top view of FIG. 1.

Referring now to FIGS. 1 and 2, there is shown machine 1 for exchanging old ties 2 of railroad track 18 for new ties 3, the track being comprised of two rails 23 fastened to the ties defining cribs therebetween, and each rail having a gage side and a field side. The machine comprises machine frame 5 supported by undercarriages 4 for mobility along the track in an operating direction indicated in FIG. 1 by arrow 22. Drive 6 propels the machine and the machine frame carries central power plant 7 supplying power to all the operating drives of the machine. Operator's cab 8 contains central control panel 9 and is mounted above, and within ready view of, the tie exchange site.

Longitudinally, vertically and transversely displaceable tie exchange device 10 is connected to machine frame 5 for laterally pulling old ties 2 out of track 18 and laterally inserting new ties 3 in the track at a tie exchange position. The tie exchange device is mounted for longitudinal displacement by drive 11 on longitudinally extending guide track 12 provided on machine frame 5. In the illustrated embodiment, the tie exchange device is suspended on the guide track by rollers engaging the guide track, at least one of which is driven, and the lower end of tie exchange device 10 carries a pair of pivotal clamps 13, 13 longitudinally spaced from each other for gripping a tie therebetween upon pivoting of the clamps, the gripping position of the clamps being illustrated in FIG. 1.

Machine 1 further comprises ballast scarifying device 15 for clearing ballast at the tie exchange position, which is arranged at a side of tie exchange device 10 opposite the side facing a tie depositing device 31. The ballast scarifying device comprises vertically and transversely adjustable ballast clearing elements 14 for clearing and planing the ballast in the cribs. Carrier frame 16 supports the ballast scarifying device, undercarriage 17 supporting one of the carrier frame ends on track 18 adjacent tie exchange device 10 while the opposite carrier frame end is linked to machine frame 5 by pivot 19.

Carrier frame supporting undercarriage 17 and adjacent ballast scarifying device 15 are arranged between tie exchange device 10 and pivot 19. Longitudinal guide 21 on machine frame 5 longitudinally displaceably supports and guides pivot 19, and drive 20 is connected to the pivot for longitudinally displacing pivot 19 and carrier frame 16 along a longitudinal displacement path corresponding at least to a minimum distance between ballast clearing elements 14 and tie exchange device 10, i.e. the distance between the transverse planes of symmetry of the ballast clearing elements and the tie exchange device.

Track lifting device 25 is mounted on carrier frame 16 adjacent ballast clearing elements 14, the track lifting device comprising means 24 for laterally engaging a respective track rail 23 and respective lifting drive 26 at each side of carrier frame 16. Longitudinal guide track 28 on machine frame 5 supports and guides carriage 27 for longitudinal displacement, the upper ends of the lifting drives being connected to the carriage. Guide rod 47 links carriage 27 to carrier frame 16, the guide rod extending at an angle to the longitudinal extension of machine frame 5.

Tie exchanging machine 1 further comprises vertically adjustable tamping heads 29 mounted below operator's cab 8 between pivot 19 and ballast clearing elements 14, a respective tamping head being associated with each rail 23 and each tamping head comprising vibratory and longitudinally reciprocable tamping tools 30. In the illustrated embodiment, the tamping heads are connected to carrier frame 16.

As shown in the drawing and more fully described and claimed in an application entitled "Tie Exchange Machine and Method" concurrently filed by the same inventors, a tie depositing device 31 is arranged adjacent front undercarriage 4 to receive old ties 2 pulled out of the track, and new ties 3 to be inserted in the track, by tie exchange device 10. Tie exchange device 10 includes tie clamps 13 adjustable to engage and release a respective tie to be exchanged, ballast clearing elements 14 of ballast scarifying device 15 and tie clamps 13 of tie exchange device 10 defining therebetween a longitudinal distance which corresponds to a maximum distance between tie clamps 13 and tie depositing device 31 upon longitudinal displacement of the carrier frame.

As shown, the machine further comprises mobile tie transporting crane 35 mounted on machine 1 for movement along track 18 towards and away from tie exchange device 10, and device 31 arranged below machine frame 5 for depositing old ties 2 pulled out of track 18 by tie exchange device 10 and new ties 3 transported by crane 28, the tie depositing device being transversely centered between the track rails. Tie transporting crane 28 comprises vertically and transversely adjustable boom 33 and tie gripping means 34 affixed to the boom. Machine frame 5 defines opening 32 enabling tie gripping means 34 to pass therethrough. Tie gripping means 34 is rotatable about a vertical axis.

The illustrated tie depositing device is a vertically adjustable fork lift, which may be slightly raised and lowered by drive 36 and comprises two transversely spaced fork parts extending substantially parallel to track rails 23 and capable of receiving a plurality of the ties 2, 3 arranged adjacent each other and extending transversely to the fork parts. A tie transport car (not shown) is coupled to the machine frame end adjacent to which tie depositing device 31 is arranged for receiving, storing and transporting ties 2 and 3. Transversely spaced rails 37 are mounted atop the machine frame end and tie transport car for moving crane 35 on wheels engaging rails 37 along track 18. Crane 35 is self-propelled and is longitudinally displaceable along track 18 on machine frame 5 and the tie transport car. The crane is carried on a flatbed support having an end supporting the crane and the support end includes flat surface 46 for storing the old and new ties.

Figure 3:
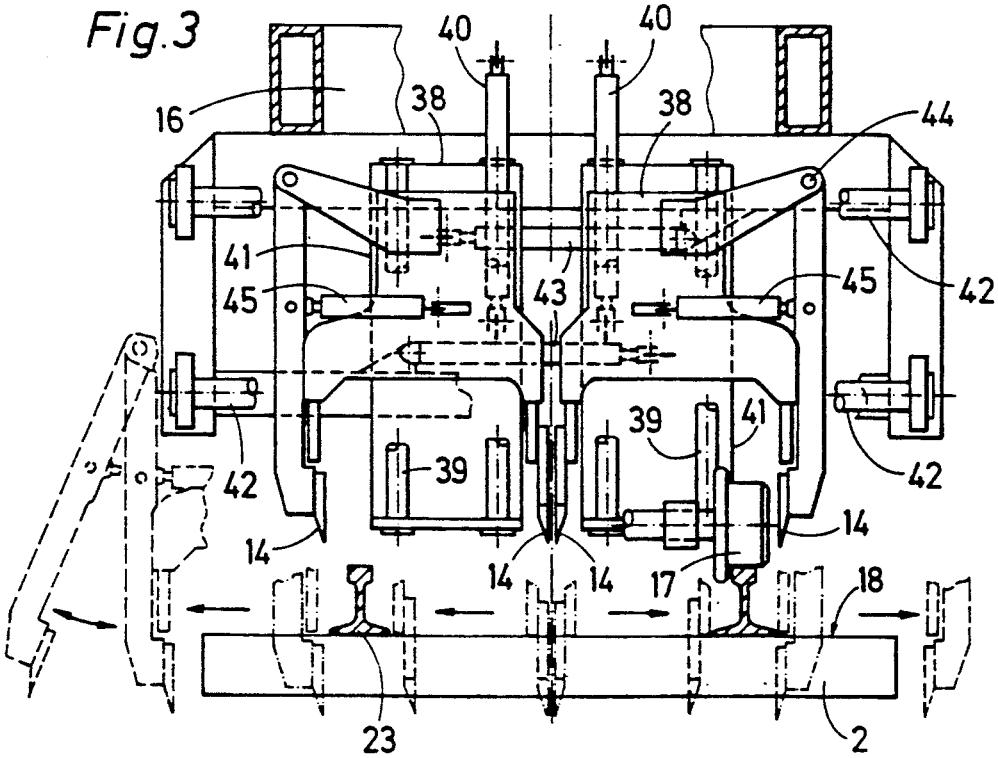
FIG. 3 is an enlarged sectional view along line III—III of FIG. 1.

As best shown in FIG. 3, ballast scarifying device 15 has four ballast clearing elements 14, the ballast clearing elements being transversely spaced from each other, a respective ballast clearing element being arranged at the field side and the gage side of each track rails 23. The ballast clearing elements are transversely and vertically displaceably connected to carrier frame 16, being affixed to carrier 38 which is vertically displaceably mounted on two vertical guide columns 39 and the vertical guide columns being affixed to a further carrier 41 which is transversely displaceably mounted on horizontal guide columns 42 affixed to carrier frame 16. Vertical displacement drive 40 is connected to carrier 38 for vertical displacement thereof along guide columns 39 and transverse displacement drive 43 is affixed to further carrier 41 for transverse displacement thereof along columns 42. The two field side ballast clearing elements 14 are pivotal about longitudinally extending axes 44 on carrier 38, and pivoting drives 45 connect the two ballast clearing elements thereto. The pivoting axes and the lower ends of the pivotal ballast clearing elements define a distance corresponding at least to a distance between two adjacent ones of the transversely spaced ballast clearing elements.

Old ties 2 of railroad track 18 are exchanged for new ties 3 with machine 1 in the following manner:

After old ties 2 have been detached from rails 23, track lifting device 25 is operated for slightly lifting the track rails off the ties and tie exchange device 10 is operated for laterally pulling one of the old ties 2 out of track 18 at a tie exchange position. Drive 11 is then operated to displace tie exchange device 10 towards tie depositing device 31 to deposit the pulled old tie on the tie depositing device adjacent and parallel to a transversely extending new tie 3. For this purpose, drive 36 is operated to raise tie depositing device 31 slightly until the pulled old tie is engaged by device 31 and comes to rest on it. Tie exchange device clamps 13 are then pivoted to release old tie 2 resting on device 31, and tie exchange device 10 is then slightly further advanced by drive 11 until clamps 13 are centered over adjacent new tie 3, whereupon clamps 13 are pivoted into gripping engagement with the new tie, drive 11 is operated to transport the new tie to the tie exchange position by returning the tie exchange device thereto, and the tie exchange device laterally inserts the new tie in track 18. While the new tie is being inserted in the track, another transversely extending new tie 3 is independently transported to, and deposited on, tie depositing device 31 at the spot from which the old tie has been removed from the tie depositing device by moving tie transporting crane 35 along track 18 towards and away from the tie exchange device. In the removal of old tie 2 from device 31 and the transport of new tie 3 from support surface 46, tie gripping means 34 grips the tie, turns it 90° so that it may pass through opening 32 in machine frame 5 as vertically adjustable boom 33 respectively raises and lowers the tie to and from surface 46 on the flatbed support of crane 35, on which the ties are stored in a transversely extending position after the tie gripping means is turned back 90°. The tie gripping means transporting a new tie is also turned back 90° after it passes through opening 32 so that new ties 3 extend transversely on tie depositing device 31. After all the stored new ties 3 have been deposited on device 31 for insertion in the track and have been replaced on storage surface 46 by old ties 2, crane 35 is moved to an adjacent tie transport car where the old ties are deposited and new ties are placed on the storage surface by the crane.

Between the pulling of the old tie and insertion of the new tie at the tie exchange site, drive 20 is operated to displace carrier frame 16 longitudinally so as to center ballast clearing and planing elements 14 of ballast scarifying device 15 over the tie exchange site from which the old tie has been removed. The ballast clearing and planing elements are then lowered by operation of drives 40 into the position shown in phantom lines in FIG. 3 and transversely displaced by drives 43 in the opposite directions indicated by small horizontal arrows in FIG. 3 to clear and plane the ballast, forming a groove which facilitates the subsequent insertion of a new tie at the tie exchange site. The resultant accumulation of ballast at the field side ballast clearing elements is further moved transversely towards the track shoulders by pivoting the field side ballast clearing elements towards the track shoulders by operation of drives 45, as indicated by broken lines in FIG. 3. During the entire tie exchange operation hereinabove described, machine 1 stands still. After this operation has been completed, the machine is slightly advanced in the operating direction indicated by arrow 22 until tamping heads 29 at each rail 23 are centered over the new tie inserted in track 18 for tamping the new tie. While the new tie is tamped, the above-described removal of old tie 2 and transport of new tie 3 by boom 33 and tie gripping means 34 may proceed unhindered.

If desired, tie exchange device 10 and/or tamping heads 29 may be mounted on carrier frame 16.

What is claimed is:

1. A machine for exchanging old ties of a railroad track for new ties, the track being comprised of two rails fastened to the ties defining cribs therebetween and each rail having a gage side and a field side, which comprises (a) a machine frame supported by undercarriages for mobility along the track, (b) a longitudinally, vertically and transversely displaceable tie exchange device connected to the machine frame for laterally pulling the old ties out of the track and laterally inserting the new ties in the track at a tie exchange position, (c) a ballast scarifying device having elements for clearing ballast in a respective one of the cribs at the tie exchange position, and (d) a carrier frame for the ballast scarifying device, the carrier frame having opposite ends longitudinally spaced from each other, (1) an undercarriage supporting one of the carrier frame ends on the track adjacent the ballast scarifying device, and (2) a pivot linking the opposite carrier frame end to the machine frame.

2. The tie exchanging machine of claim 1, wherein the carrier frame supporting undercarriage and the adjacent ballast scarifying device are arranged between the tie exchange device and the pivot.

3. The tie exchanging machine of claim 1, further comprising longitudinal guide means on the machine frame for longitudinally displaceably supporting and guiding the pivot, and a drive connected to the pivot for longitudinally displacing the pivot and the carrier frame along a longitudinal displacement path corresponding at least to a minimum distance between the ballast clearing elements and the tie exchange device.

4. The tie exchanging machine of claim 1, further comprising a track lifting device mounted on the carrier frame adjacent the ballast clearing elements, the track lifting device comprising means for laterally engaging a respective one of the track rails and a lifting drive having an upper end, a longitudinal guide track on the machine frame, and a carriage supported and guided on the guide track for longitudinal displacement, the upper end of the lifting drive being connected to the carriage.

5. The tie exchanging machine of claim 4, further comprising a guide rod linking the carriage to the carrier frame, the guide rod extending at an angle to the longitudinal extension of the machine frame.

6. The tie exchanging machine of claim 1, further comprising a vertically adjustable tamping head mounted between the pivot and the ballast clearing elements, the tamping head comprising vibratory and longitudinally reciprocable tamping tools.

7. The tie exchanging machine of claim 6, wherein the tamping head is connected to the carrier frame.

8. The tie exchanging machine of claim 1, further comprising a tie depositing device arranged to receive old ties pulled out of the track, and new ties to be inserted in the track, by the tie exchange device, the tie exchange device including tie clamps adjustable to engage and release a respective one of the ties to be exchanged, the ballast clearing elements of the ballast scarifying device and the tie clamps of the tie exchange device defining therebetween a longitudinal distance which corresponds to a maximum distance between the tie clamps and the tie depositing device upon longitudinal displacement of the carrier frame.

9. The tie exchanging machine of claim 1, wherein the ballast scarifying device has four ballast clearing elements, the ballast clearing elements being transversely spaced from each other and being transversely and vertically displaceably connected to the carrier frame, two of the ballast clearing elements being arranged adjacent the field sides of the rails and being pivotal about longitudinally extending axes on the carrier frame, and further comprising pivoting drives connecting the two ballast clearing elements to the carrier frame.

10. The tie exchange machine of claim 9, wherein the pivoting axes and the lower ends of the pivotal ballast clearing elements define a distance corresponding at least to a distance between two adjacent ones of the transversely spaced ballast clearing elements.

* * * * *